US010551859B2

(12) United States Patent
Gakhar et al.

(10) Patent No.: US 10,551,859 B2
(45) Date of Patent: Feb. 4, 2020

(54) METHODS AND APPARATUS FOR OVERSHOOT, UNDERSHOOT AND DELAY REDUCTION OF A VOLTAGE REGULATOR OUTPUT BY DYNAMICALLY OFFSETTING A REFERENCE VOLTAGE

(71) Applicant: Texas Instruments Incorporated, Dallas, TX (US)

(72) Inventors: Vikram Gakhar, Bengaluru (IN); Preetam Tadeparthy, Bengaluru (IN); Dattatreya Baragur Suryanarayana, Bedford, NH (US); Muthusubramanian Venkateswaran, Bengaluru (IN); Vikas Lakhanpal, Bengaluru (IN)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 15/596,864

(22) Filed: May 16, 2017

(65) Prior Publication Data

US 2017/0336818 A1 Nov. 23, 2017

(30) Foreign Application Priority Data

May 17, 2016 (IN) ..... 201641016971

(51) Int. Cl.
*G05F 1/575* (2006.01)

(52) U.S. Cl.
CPC ..... *G05F 1/575* (2013.01)

(58) Field of Classification Search
CPC . G05F 1/575; G05F 1/56; G05F 1/565; G05F 1/46; G05F 1/567; H02M 3/156; H02M 3/073; H02M 3/1588; H02M 3/1584; H02M 3/158; H02M 3/157; H02M 3/33507; H02M 3/1563; H02M 2001/0009; H02M 2001/0012; H02M 2001/0025; H02M 2001/0032; H02M 2001/0045
USPC ..... 323/273, 280–286, 288
See application file for complete search history.

(56) References Cited

U.S. PATENT DOCUMENTS 5,635,773 A * 6/1997 Stuart ..... H02J 9/062 307/66
2007/0040536 A1* 2/2007 Smith, Jr. ..... H02M 3/157 323/280
2010/0102785 A1* 4/2010 Young ..... H02M 3/156 323/234
2011/0018507 A1* 1/2011 McCloy-Stevens ..... H02M 3/1588 323/271
2011/0101937 A1* 5/2011 Dobkin ..... H02M 3/156 323/282
2011/0176337 A1* 7/2011 Young ..... H02M 3/156 363/21.11

(Continued)

*Primary Examiner* — Adolf D Berhane
*Assistant Examiner* — Kevin H Sprenger
(74) *Attorney, Agent, or Firm* — Lawrence J. Bassuk; Charles A. Brill; Frank D. Cimino

(57) ABSTRACT

In a described example, a method includes using a power supply, supplying an output voltage that varies in response to a reference voltage; detecting a voltage ramp in an input reference voltage; generating an offset voltage waveform; adding the offset voltage waveform to the input reference voltage to generate a second reference voltage; and using the second reference voltage, operating the power supply to supply the output voltage.

20 Claims, 6 Drawing Sheets

(56) References Cited

U.S. PATENT DOCUMENTS

| | | | | |
|---|---|---|---|---|
| 2011/0316518 | A1* | 12/2011 | Feng | H02M 3/156<br>323/349 |
| 2012/0153921 | A1* | 6/2012 | Brokaw | H02M 3/156<br>323/288 |
| 2013/0119953 | A1* | 5/2013 | Murase | H02M 3/1588<br>323/271 |
| 2013/0342181 | A1* | 12/2013 | Suppanz | H02M 3/156<br>323/271 |
| 2014/0084884 | A1* | 3/2014 | Lee | H02M 3/157<br>323/271 |
| 2014/0103894 | A1* | 4/2014 | McJimsey | G05F 1/67<br>323/282 |
| 2016/0116925 | A1* | 4/2016 | Freeman | H02M 3/33546<br>307/130 |
| 2017/0070149 | A1* | 3/2017 | Guan | H02M 3/158 |
| 2017/0133842 | A1* | 5/2017 | Freeman | H02J 1/00 |

* cited by examiner

METHODS AND APPARATUS FOR OVERSHOOT, UNDERSHOOT AND DELAY REDUCTION OF A VOLTAGE REGULATOR OUTPUT BY DYNAMICALLY OFFSETTING A REFERENCE VOLTAGE

RELATED APPLICATIONS

This patent application claims priority under 35 USC § 119(a) to co-owned India Provisional Patent Application No. 201641016971, titled "OVERSHOOT/UNDERSHOOT AND DELAY REDUCTION OF A VOLTAGE REGULATOR OUTPUT BY DYNAMICALLY OFFSETTING THE REFERENCE VOLTAGE," filed May 17, 2016, which is hereby fully incorporated herein by reference.

TECHNICAL FIELD

This disclosure relates generally to electronic power supplies, and more particularly to variable output voltage power supply regulation.

BACKGROUND

A broad range of electronic systems employ power supplies with output voltages that can vary while the system is operating. Systems that operate with varying supply voltages from these power supplies include devices that reduce energy consumption at times when system functionality can be reduced. Computing systems often employ processors that can dynamically vary processing performance by, in part, operating at different voltage levels. "Sleep" or "standby" modes reduce power consumption, for example. Examples of such systems are laptop and desk top computers, servers, and battery powered mobile devices such as smartphones, netbook computers, mobile telephones, handheld games, and tablet computing devices. Systems other than computing devices may also have variable power supplies that reduce energy use and cost of operation in different modes of operation. The term "variable power supply" as used herein refers to power supplies with dynamically variable output voltage.

Devices that operate with variable power supplies often require that the output voltage transitions between different output voltage levels occur within a specified timeframe, and with little or no output voltage overshoot and/or undershoot. An under-damped voltage control loop of a power supply often results in rapid output voltage transitions, but may also cause excessive voltage overshoot and/or undershoot when transitioning between different output voltages. A power supply employing an over-damped voltage control loop may have little or no output voltage overshoot and undershoot, but excessive delays may occur when transitioning between output voltages.

SUMMARY

In a described example, a method includes using a power supply, supplying an output voltage that varies in response to a reference voltage; detecting a voltage ramp in an input reference voltage; generating an offset voltage waveform; adding the offset voltage waveform to the input reference voltage to generate a second reference voltage; and using the second reference voltage, operating the power supply to supply the output voltage.

DETAILED DESCRIPTION

Figure 1:
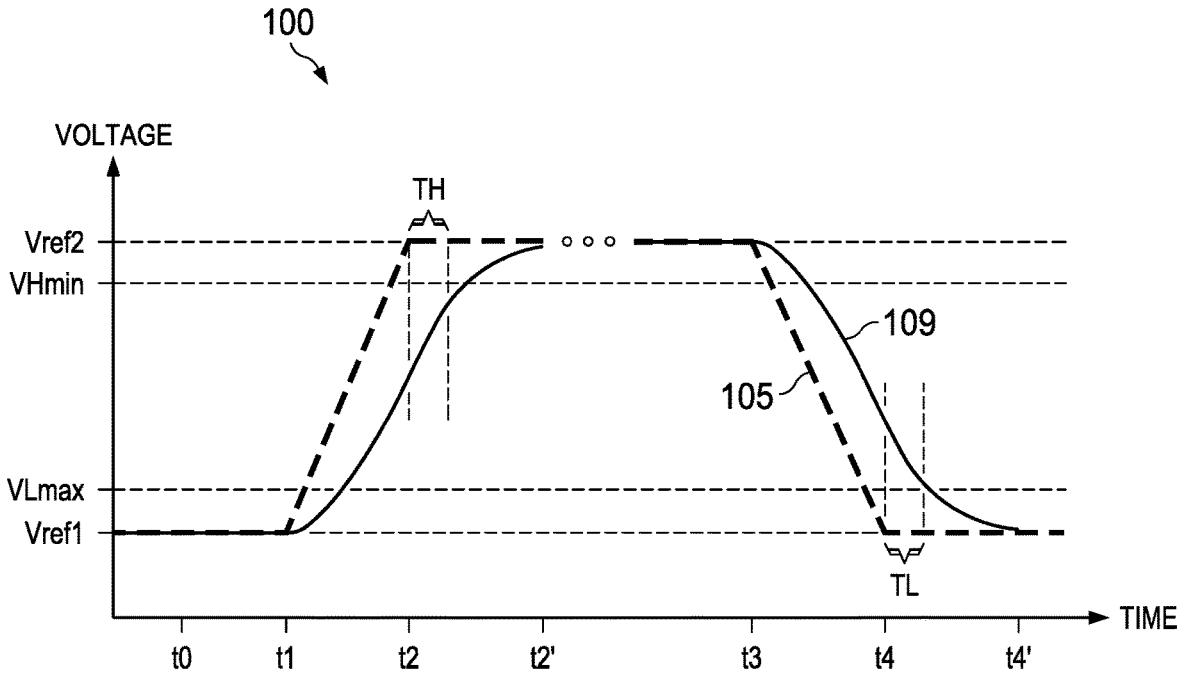
FIG. 1 illustrates a set of signal traces depicting an over-damped output voltage response for an example variable power supply.

Corresponding numerals and symbols in the different figures generally refer to corresponding parts unless otherwise indicated. The figures are not necessarily drawn to scale.

The term "coupled" may include connections made with intervening elements, and additional elements and various connections may exist between any elements that are "coupled." The terms "line" and "bus" are used herein to refer to connecting elements such as (and not limited to) metal interconnects on an integrated circuit and traces on a circuit board. A bus is typically made of multiple lines. A line or bus coupled to two or more circuit elements may include intervening elements, and additional elements can be used that are not illustrated and not described herein. The incorporation of such intervening and additional elements is dependent upon a circuit implementation for a specific application. Examples of intervening and additional elements include buffers to increase signal drive strength and passive elements such as resistors.

Figures herein that illustrate signal traces and timing diagrams are drawn such that time scales for all traces and timing diagrams within an individual figure are approximately the same and are aligned vertically within the figure. The approximately simultaneously occurring states of all signals illustrated in a figure are drawn as vertically aligned. The signal trace diagrams herein are drawn with representative and approximate waveform shapes. Signal delays through circuit elements are not illustrated unless important to the explanation of circuit operation.

Variable power supplies dynamically modify a reference voltage used to regulate the power supply output voltage. Many power supplies employ a control loop that modifies power supply output voltage such that it is approximately equivalent to the instantaneous reference voltage level (or a scaled reference voltage level). Such control loops subtract the output voltage from the reference voltage. This difference is an error voltage used to adjust the output voltage, thus closing the control loop. The approach for adjusting the output voltage depends upon the implementation of the power supply. For example, a switching power supply may use pulse width modulation (PWM) to control the power supply output voltage such that the output voltage is a function of the duty cycle of the PWM. Such a switching power supply modifies the duty cycle of the PWM based on the magnitude of the hereinabove described error voltage. The system operates to minimize the error voltage, and thus adjusts the output voltage to the reference voltage level, or to a multiple of the reference voltage. In this example, when a change in system operation requires a change to the power supply output voltage, the system modifies the power supply reference voltage. This reference voltage change results in an error voltage change. The PWM duty cycle changes in response to the error voltage change, and the output voltage of the power supply changes in response to the change in PWM duty cycle. Thus the power supply output voltage changes to be approximately equivalent to the new reference voltage set by the system. In a PFM (pulse frequency modulation) switching power supply, a fixed duty cycle switching signal has a varying frequency of operation. The output voltage is then proportional to the frequency used at a given time. A change in the reference voltage to the power supply results in an error voltage change, and control circuitry changes the pulse frequency to cause the output voltage to match the new reference voltage, and therefore minimize the error voltage.

Figure 2:
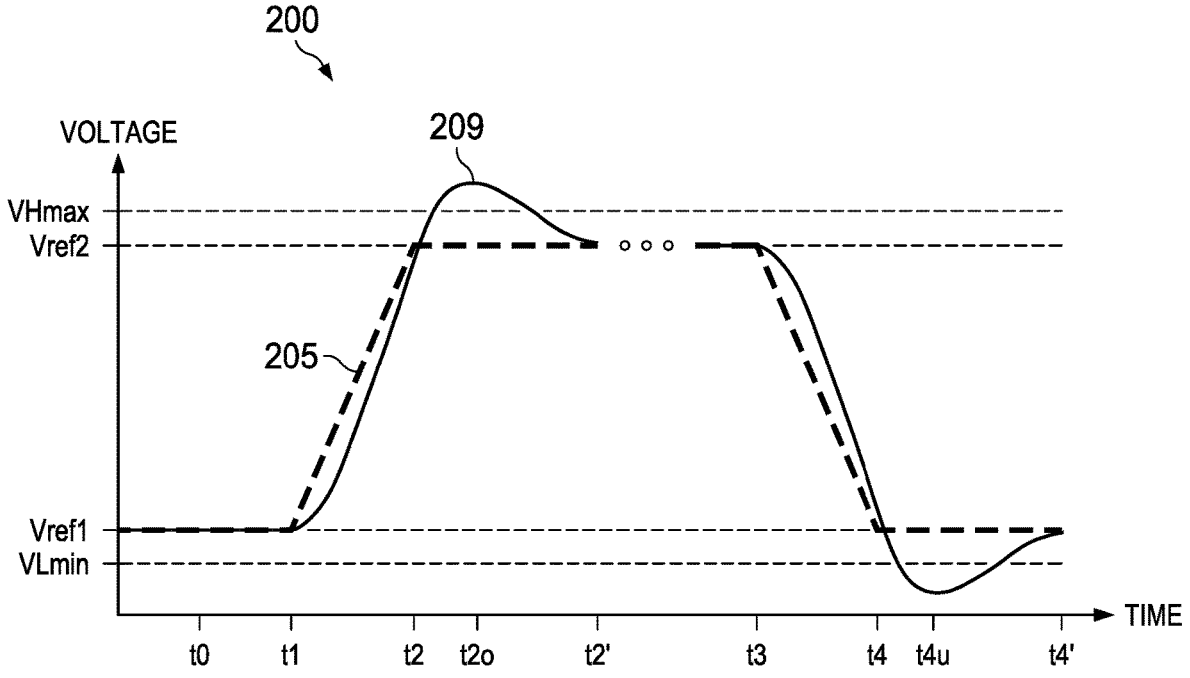
FIG. 2 illustrates a set of signal traces depicting an under-damped output voltage response for an example variable power supply.

The dynamic response of the control loop used in the power supply can result in excessive delays of output voltage transitions following changes in the reference voltage. An over-damped output voltage response often results in such delays. The dynamic response of the control loop can also result in excessive output voltage overshoot and undershoot compared to the reference voltage when voltage transitions occur. As used herein, overshoot and undershoot includes voltage ringing. An under-damped output voltage response often results in overshoot and undershoot in the output voltage level. FIGS. 1 and 2 described hereinbelow illustrate examples of over-damped and under-damped power supply output voltage responses for variable power supplies.

FIG. 1 is a timing diagram that presents signal traces 100 illustrating an over-damped output voltage response for a variable output voltage power supply. Trace 105 of FIG. 1 illustrates the power supply reference voltage. In the example of FIG. 1, the reference voltage (trace 105) is initially at the voltage Vref1 at time t0. The reference voltage (trace 105) then transitions in a voltage ramp transition to the voltage Vref2 starting at time t1 and reaching voltage Vref2 at time t2 as illustrated in FIG. 1. After a period of time (illustrated with the series of dots) elapses, the reference voltage (trace 105) transitions in a voltage ramp transition from the voltage Vref2 to the voltage Vref1 starting at time t3 and ending at time t4. As illustrated in FIG. 1 the reference voltage (trace 105) transitions between the two voltages Vref1 and Vref2 are voltage ramps over time. The power supply output voltage (trace 109 of FIG. 1) tracks the reference voltage (trace 105). Initially, while the reference voltage (trace 105) is the voltage Vref1, the power supply output voltage (trace 109) is approximately this same voltage. When the reference voltage (trace 105) transitions from the voltage Vref1 to the voltage Vref2 starting at time t1 and ending at time t2 in FIG. 1, the power supply output voltage (trace 109) also transitions to approximately this same voltage as illustrated in FIG. 1. The transition of the power supply output voltage (trace 109) does not overshoot the voltage Vref2. However, the transition of the power supply output voltage (trace 109) to approximately the voltage Vref2 is significantly delayed following completion of the reference voltage (trace 105) transition to the voltage Vref2. The power supply output voltage reaches the voltage Vref2 later in the timing diagram, this is shown as time t2' in FIG. 1. When the reference voltage (trace 105) transitions from the voltage Vref2 to the voltage Vref1, stating at time t3 and ending at time t4 in FIG. 1, the power supply output voltage (trace 109) also transitions to approximately this same voltage as illustrated in FIG. 1. The transition of the power supply output voltage (trace 109) does not undershoot the voltage Vref1. However, the transition of the power supply output voltage (trace 109) to approximately the voltage Vref1 is significantly delayed following the completion of the reference voltage (trace 105) transition to the voltage Vref1, finally the power supply voltage output reaches the voltage of Vref1 at time t4' in FIG. 1.

Systems are often implemented with maximum delay time requirements for power supply output voltage transitions. In the example of FIG. 1 two such maximum delay times are illustrated. In the example of FIG. 1, the maximum delay for the output voltage (trace 109) to complete a transition to approximately Vref2 is now described. The output voltage (trace 109) is to increase to the voltage VHmin within the time TH following the completion of the voltage ramp of the reference voltage (trace 105 of FIG. 1) to the voltage Vref2. The voltage VHmin and the time TH are illustrated in FIG. 1. In the example of FIG. 1, the maximum delay for the output voltage (trace 109) to complete a transition to approximately Vref1 is now described. The output voltage (trace 109) is to decrease to the voltage VLmax within the time period TL following the completion of the voltage ramp of the reference voltage (trace 105 of FIG. 1) to the voltage Vref1. The voltage VLmax and the time period TL are illustrated in FIG. 1. Thus the transitions of output voltage (trace 109) illustrated in FIG. 1 exceeds the hereinabove described maximum delay time requirements.

For variable power supplies where these maximum delay time requirements are not met, various approaches may be used to resolve the failure to meet these requirements. One approach is to implement the power supply with reduced damping of the output voltage response. This approach may result in disadvantageous output voltage overshoot and undershoot when output voltage transitions occur. Another approach is to relax the maximum delay time requirements such that the over-damped output voltage response meets the requirements. For these two alternatives, modifications may be necessary to the implementation of the system employing the power supply. The power supply can be implemented with a higher bandwidth control loop to reduce delay of the output voltage transitions without introducing overshoot and undershoot. However the use of a higher bandwidth control loop can reduce power supply efficiency. Other approaches include the use of a more complex power supply implementation, which can also increase circuit cost, device area, and increase power demands.

FIG. 2 is a timing diagram that presents signal traces 200 illustrating under-damped output voltage response for an example variable power supply. Similar reference labels are used in FIG. 2 for similar traces in FIG. 1, for clarity, Trace 205 of FIG. 2 illustrates the power supply reference voltage. In the example of FIG. 2, the reference voltage (trace 205) is initially the voltage Vref1 as shown at time t0 in FIG. 2. Starting at time t1, the reference voltage (trace 205) then transitions to the voltage Vref2 as illustrated in FIG. 2 at time t2. After a period of time illustrated by the series of horizontal dots, staring at time t2 the reference voltage (trace 205) transitions from the voltage Vref2 to the voltage Vref1 starting at time t3 and ending at time t4. As illustrated in FIG. 2 the reference voltage (trace 205) transitions between the voltages Vref1 and Vref2 are ramps over time. The power supply output (trace 209 of FIG. 2) tracks the reference voltage (trace 205). Initially, at time t0 and up to time t1, while the reference voltage (trace (205) is the voltage Vref1, the power supply output voltage (trace 209) is approximately this same voltage. When the reference voltage (trace 205) transitions from the voltage Vref1 to the voltage Vref2 (starting at time t1), the power supply output voltage (trace 209) also transitions to approximately this same voltage as illustrated in FIG. 2 starting at time t1. The transition of the power supply output voltage (trace 209) overshoots the voltage Vref2 as shown at time t2*o*. However, the transition of the power supply output voltage (trace 209) to approximately the voltage Vref2 is not significantly delayed following the completion of the reference voltage (trace 205) transition to the voltage Vref2. As shown in FIG. 2 at time t2, the power supply output voltage (trace 209) reaches the voltage Vref2 just after time t2, overshoots the reference voltage at time t2*o*, and settles at the reference voltage Vref2 at time t2'.

When the reference voltage (trace 205) transitions from the voltage Vref2 to the voltage Vref1 starting at time t3, the power supply output voltage (trace 209) also transitions to approximately this same voltage as illustrated in FIG. 2, starting just after time t3 and reaching Vref1 just after time t4. The transition of the power supply output voltage (trace 209) undershoots the voltage Vref1 at time t4*u*. However, the transition of the power supply output voltage (trace 209) to approximately the voltage Vref1 is not significantly delayed following the completion of the reference voltage (trace 205) transition to the voltage Vref1. The output voltage (trace 209) follows the reference voltage (trace 205) from Vref2 at time t3 to Vref1 at time t4 very closely. The output voltage settles at the reference voltage Vref1 at time t4'; at a time after the undershoot at time t4*u*.

Systems often have requirements that the power supply output voltage complete transitions to a new voltage with limited undershoot and overshoot. In the example of FIG. 2 two such limits are illustrated. In the example of FIG. 2, the overshoot limit is defined as the output voltage (trace 209) should not exceed VHmax when transitioning to the voltage Vref2. In the example of FIG. 2, the undershoot limit is defined as the output voltage (trace 209) should not fall below VLmin when transitioning to the voltage Vref1. Thus the output voltage (trace 209) shown in the example of FIG. 2 does not meet the overshoot and undershoot limit requirements. For power supplies where such overshoot and undershoot limit requirements are not met, various approaches may be used to resolve the failure to meet these requirements. One approach is to increase output capacitance of the power supply to reduce overshoot and undershoot. Increasing output capacitance often results in increased settling time for the output voltage. Another approach is to relax the overshoot and undershoot limit requirements such that a specific conventional power supply implementation meets the relaxed limit requirements. For these alternatives, modifications to the implementation of the system employing the conventional power supply may be necessary. Increasing the control loop bandwidth can reduce overshoot and undershoot without increasing the settling time when the output voltage transitions occur. Increasing the control loop bandwidth typically results in reduced efficiency of the power supply. Other approaches include a more complex power supply implementation, requiring additional device or circuit board area and added circuitry, increasing power consumption.

Additional requirements for the output voltage may be established, in addition to the overshoot and undershoot limits and the maximum delay time requirement described hereinabove. These additional requirements are not described herein for simplicity of explanation.

Figure 3:
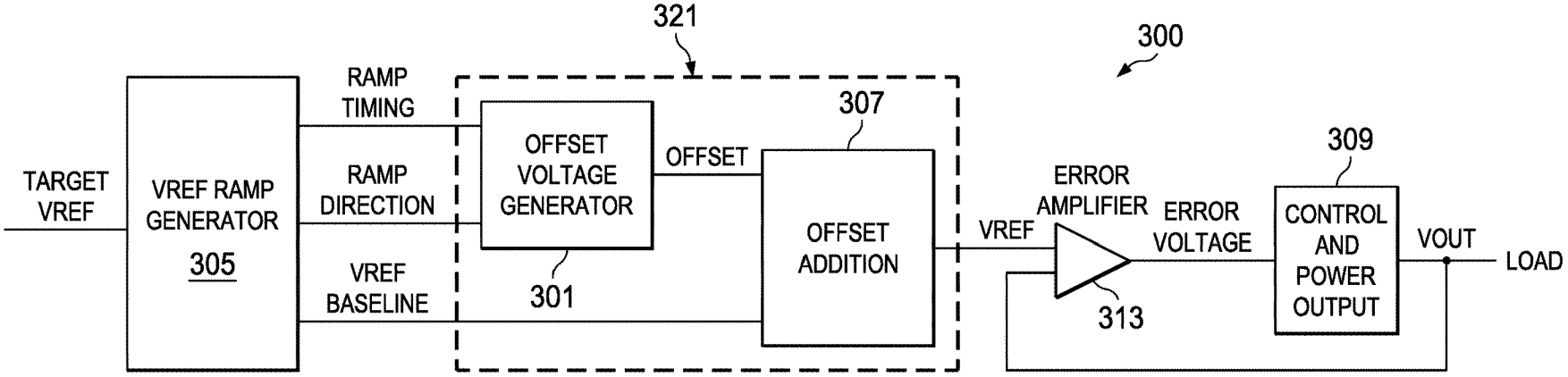
FIG. 3 is a block diagram illustrating a portion of a variable power supply circuit including an example arrangement.

FIG. 3 is a block diagram illustrating a portion of an example variable power supply circuit 300. Circuit 300 includes an example overshoot, undershoot, and delay reduction circuit. The example arrangement illustrated in FIG. 3 includes the group of circuits 321 that provide an offset voltage to the reference voltage VREF.

In the example of FIG. 3, the line labeled "target VREF" is an input of the VREF ramp generator (block 305 of FIG. 3). The line target VREF is coupled to a circuit external to FIG. 3 such as a data bus interface. The output of the VREF ramp generator (block 305) is coupled to the line labeled "VREF baseline" in FIG. 3. Another output of the VREF ramp generator (block 305) is coupled to the line labeled "ramp timing" in FIG. 3. The line ramp timing of FIG. 3 is also coupled to an input of the offset voltage generator 301. Another output of the VREF ramp generator 305 is coupled to the line labeled "ramp direction" in FIG. 3. The line ramp direction is coupled to an input of t offset voltage generator 301. The line VREF baseline of FIG. 3 is coupled to an input of an offset addition circuit 307. The output of offset voltage generator 301 is coupled to the line labeled "offset" in FIG. 3. The line offset of is also coupled to an input of offset addition circuit 307. The output of the offset addition circuit 307 is coupled to the line labeled VREF in FIG. 3. The line VREF is coupled to an input of the error amplifier 313. The output of the error amplifier 313 is coupled to line labeled "error voltage" in FIG. 3. The line error voltage is coupled to an input of the control and power output circuit 309. The output of the control and power output circuit 309 is the line labeled VOUT in FIG. 3. The line VOUT of FIG. 3 is coupled to an external circuit indicated by the label "load" in FIG. 3. The line VOUT is coupled to an input of the error amplifier 313.

For a power supply implemented for a specific application, the circuits and blocks illustrated in FIG. 3 may have additional inputs and outputs not illustrated and not described herein for simplicity of explanation. The example arrangement of FIG. 3 can be implemented as different types of variable power supplies. These types of power supplies include buck, boost, buck-boost, linear (non-switched), multi-phase switched supplies, and supplies with multiple voltage outputs. Additional components used with power supplies such as inductors and capacitors coupled to the output VOUT are not illustrated in FIG. 3, for simplicity of explanation.

In operation, a circuit external to FIG. 3 outputs a voltage on the line target VREF of FIG. 3. The voltage on the line target VREF of FIG. 3 corresponds to the approximate voltage level to be output by the power supply (300) on the line VOUT. In an alternative example, scaling circuitry (not shown) can be used so that the input signal target VREF is multiplied by a scaling factor. The VREF ramp generator 305 produces a voltage ramp on the line VREF baseline of FIG. 3 beginning with the present voltage level on the line VREF baseline and ramping to approximately the voltage level on the line target VREF of FIG. 3. The terms "voltage ramp" and "ramp" are used herein in reference to an increase or a decrease in voltage over time. In the example of FIG. 3 the voltage ramps on the line VREF baseline of FIG. 3 are approximately linear; however, in an alternative arrangement, non-linear ramps can be used. In the example arrangement of FIG. 3, the VREF ramp generator 305 outputs a logic high on the line "ramp timing" of FIG. 3 at the beginning of a voltage ramp and a logic low at the completion of a voltage ramp. The example offset voltage generator 301 outputs an offset voltage waveform on the line "offset" of FIG. 3 beginning when the signal on the line ramp timing transitions to a logic high. The offset addition circuit 307 sums the voltages on the lines offset and VREF baseline of FIG. 3. This summed signal is output on the line VREF in FIG. 3. The waveforms output by the offset voltage generator (block 301) are further described hereinbelow in the explanations of FIGS. 4 and 5. When not outputting an offset voltage waveform, the offset voltage generator 301 outputs approximately zero volts on the line offset of FIG. 3. Error amplifier 313, control and power output block 309, and the output voltage VOUT form a feedback control loop for the power supply 300. The error amplifier 313 subtracts the voltage on the line VOUT of FIG. 3 from the voltage on the line VREF. This voltage difference is modified by the gain and voltage vs. time response of the error amplifier 313 and is output on the line "error voltage" of FIG. 3. The control functionality of the control and power output circuit 309 modifies the operation of the power output portion of block 309 in response to the voltage on the line error voltage, thus adjusting the voltage on the line VOUT to minimize the error voltage until the output voltage VOUT reaches the voltage VREF.

The example of FIG. 3 can be implemented for power supplies with over-damped and under-damped output voltage response to dynamic voltage changes. The offset voltage generator (block 301 of FIG. 3) outputs offset voltage waveforms on the line labeled "offset" in FIG. 3 that depend on the response characteristics (over-damped or under-damped) of the power supply output voltage when dynamically changing voltage level. Examples for cases of over-damped and under-damped output voltage response characteristics are described hereinbelow. The voltage vs. time characteristics of these waveforms on the line offset of FIG. 3 can also depend on other characteristics of specific power supply implementations which are not provided here, for simplicity of explanation.

Figure 4:
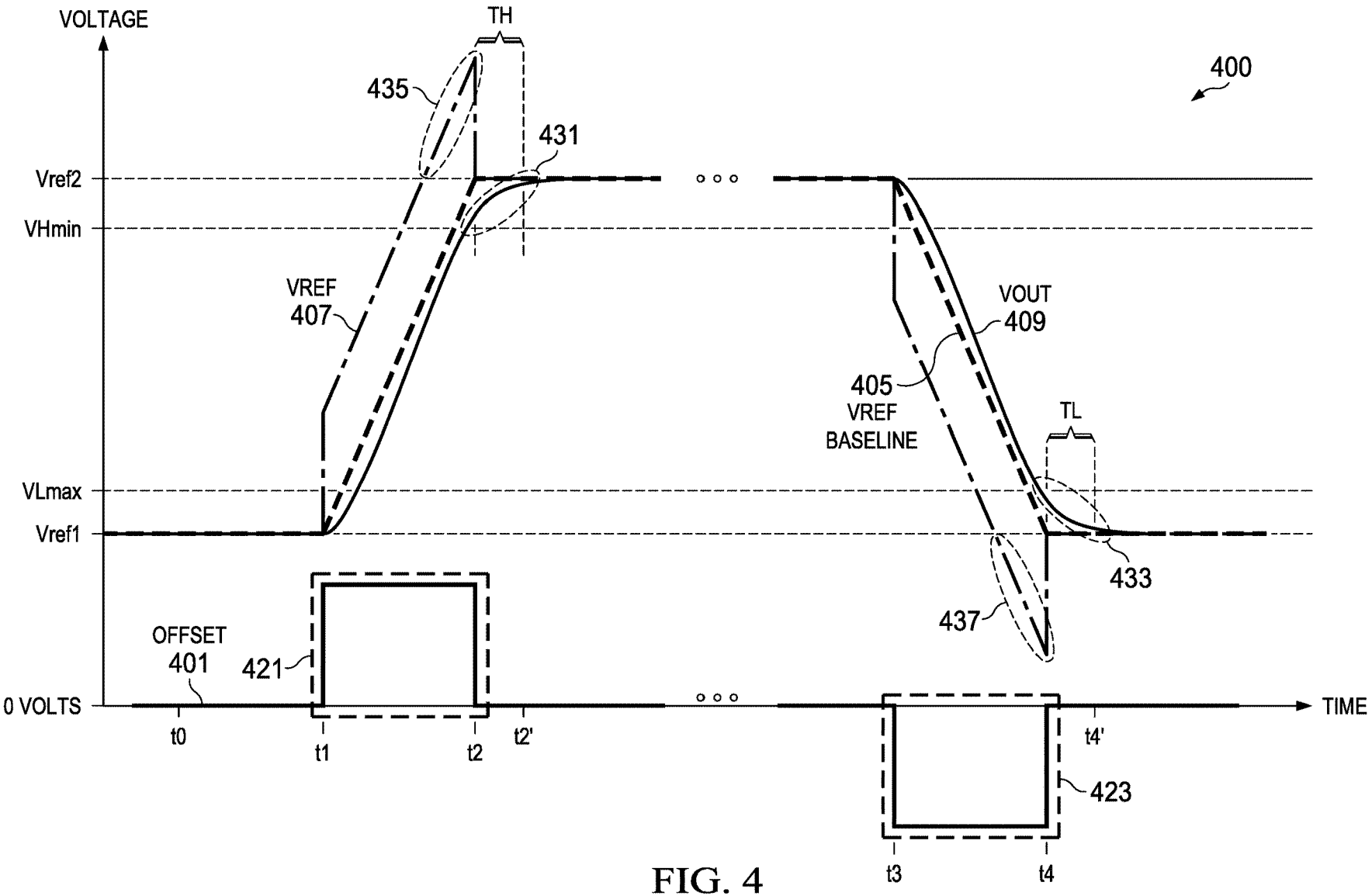
FIG. 4 illustrates a group of signal traces of the signals on selected lines illustrated in FIG. 3.

FIG. 4 is a timing diagram illustrating a group of signal traces 400 for selected lines illustrated in FIG. 3. The signal traces illustrated in FIG. 4 correspond to an example implementation of circuit 300 of FIG. 3 with an over-damped output voltage response to dynamic voltage changes. In the timing diagram illustrated in FIG. 4, initially, at time t0, the voltage on the line target VREF of FIG. 3 is approximately at the voltage labeled Vref1. In this example, starting at time t1 in FIG. 4, the voltage on the line target VREF of FIG. 3 transitions from this initial level of Vref1 to approximately the voltage labeled Vref2 at time t2. In the example of FIG. 4, this transition is followed by a transition starting at time t3 and ending at time t4 from the voltage level Vref2 to approximately the voltage Vref1. In response to this sequence of voltage levels on the line target VREF of FIG. 3, the VREF ramp generator (block 305 of FIG. 3) outputs a signal on the line VREF baseline of FIG. 3 that corresponds to the signal labeled "VREF baseline" (trace 405 of FIG. 4). In response to the signals on the lines ramp timing and ramp direction of FIG. 3, the offset voltage generator (block 301 of FIG. 3) outputs a signal on the line offset of FIG. 3 corresponding to the signal labeled "offset" (trace 401 of FIG. 4). When the signal on the line ramp timing of FIG. 3 transitions to a high level and the signal on the line ramp direction of FIG. 3 is high, the offset voltage generator (block 301 of FIG. 3) outputs the waveform corresponding to event 421 of trace 401 at time t1 in FIG. 4 on the line offset of FIG. 3. When the signal on the line ramp timing of FIG. 3 transitions to a high level and the signal on the line ramp direction of FIG. 3 is low, the offset voltage generator (block 301 of FIG. 3) outputs the waveform corresponding to event 423 of trace 401 at time t3 in FIG. 4 on the line offset of FIG. 3. The example offset addition circuit (block 307 of FIG. 3) sums voltages on the lines VREF baseline and offset of FIG. 3 corresponding to the traces 405 and 401 respectively of FIG. 4. The sum of these two voltages is output on the signal VREF of FIG. 3 corresponding to the signal labeled VREF (trace 407 of FIG. 4). In response to the signal VREF (trace 407 of FIG. 4) the power supply adjusts the output voltage on the line VOUT of FIG. 3 corresponding to the signal labeled VOUT (trace 409 of FIG. 4) as described hereinabove.

Due to the voltage of the signal VREF (trace 407 of FIG. 4) being approximately the sum of the voltages of the signals VREF baseline (trace 405) and offset (trace 401 of FIG. 4), the voltage ramps of the signal VREF (trace 407 in FIG. 4) occur prior to the corresponding voltage ramps of the signal VREF baseline (trace 405) as illustrated in FIG. 4. The voltage ramps of the signal VOUT (trace 409 of FIG. 4) are significantly delayed from the voltage ramps of the signal VREF (trace 407) due to the over damped response of the signal VOUT (trace 409) to changes in the signal VREF (trace 407). However, because voltage ramps of the signal VREF (trace 407) occur prior to voltage ramps of the signal VREF baseline (trace 405), the voltage ramps of the signals VOUT (trace 409) and VREF baseline (trace 405) of FIG. 4 occur closely in time as illustrated in FIG. 4. That is, the delay in the feedback control loop is corrected by adding or subtracting an offset voltage to correct the voltage VOUT so that it will follow voltage VREF baseline closely. In addition, the voltage of the signal VOUT (trace 409 of FIG. 4) rapidly transitions from voltage ramps to near constant voltage (examples are shown as events 431 and 433 of trace 409 in FIG. 4). This rapid transition is due to the voltage of the signal VREF (trace 407) overshooting and undershooting the voltage of the signal VREF baseline (trace 405 of FIG. 4) at the completion of increasing and decreasing (respectively) voltage ramps (examples are events 435 and 437 respectively of trace 407 in FIG. 4). These voltage overshoots and undershoots (events 435 and 437 of trace 407) are due to the voltage of the signal VREF (trace 407) being the sum of the voltages of the signals VREF baseline (trace 405) and offset (trace 401 of FIG. 4). Thus, a power supply with an over-damped output voltage response employing the example arrangement operates such that requirements for the voltage of the signal VOUT (trace 409 of FIG. 4) completing a voltage ramp are met. An example of these requirements is now described.

When the voltage of the signal VOUT (trace 409 of FIG. 4) is transitioning from approximately the voltage Vref1 in FIG. 4 to approximately the voltage Vref2 in FIG. 4, starting at time t1 and extending to time t2 in FIG. 4, the voltage of the signal VOUT (trace 409) is to increase to the voltage VHmin prior to the end of time period TH following the completion of the voltage ramp of the signal VREF baseline (trace 405 of FIG. 4) to approximately the voltage Vref2. The time the output voltage VOUT reaches the level Vref2 is shown at time t2' in FIG. 4. The voltage VHmin and the time period TH are illustrated in FIG. 4. In addition, when the voltage of the signal VOUT (trace 409) is transitioning from approximately the voltage Vref2 in FIG. 4 to approximately the voltage Vref1 in FIG. 4, starting at time t3 and ending at time t4, the voltage of the signal VOUT (trace 409) is to decrease to the voltage VLmax prior to time period TL following the completion of the voltage ramp of the signal VREF baseline (trace 405 of FIG. 1) to approximately the voltage Vref1 (at time t4). The time the signal VOUT reaches the level Vref2 is shown as time t4' in FIG. 4. The voltage VLmax and the time period TL are illustrated in FIG. 4

As described hereinabove, the voltage ramps of the signal VREF (trace 407 of FIG. 4) occur prior to the ramps of the signal VREF baseline (trace 405 of FIG. 4). For example, at time t1 the signal trace offset has a positive pulse and at approximately the same time the signal VREF immediately rises and then begins an increasing voltage ramp. At time t2, the signal VREF is shown with significant overshoot above the reference voltage level Vref2. The amount of time by which the voltage ramps of trace 407 precede the corresponding ramps of trace 405 is a function of the maximum and minimum voltages of the waveforms on the signal offset (trace 401 of FIG. 4). At time t3 in FIG. 4, prior the start of the decreasing ramp in the voltage VREF baseline, the offset signal goes negative, and at about the same time, the VREF signal immediately drops in voltage and then starts a decreasing ramp that continues to time t4. At time t4 the voltage VREF is shown with significant undershoot below the reference voltage Vref1. The output voltage VOUT reaches voltage Vref1 at time t4', when the offset voltage in trace 401 is again 0 volts.

Figure 5:
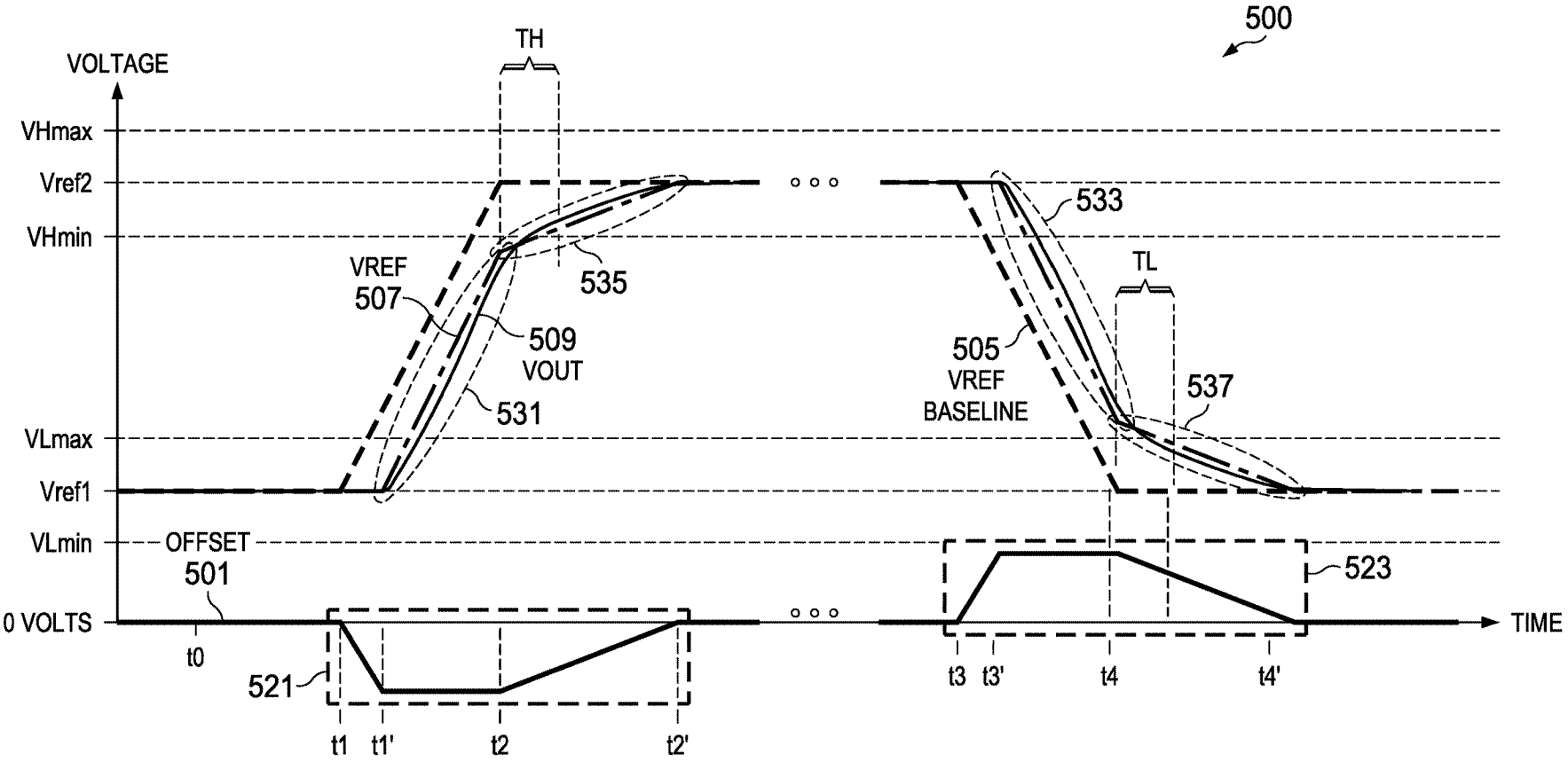
FIG. 5 illustrates a group of signal traces of the signals on selected lines illustrated in FIG. 3.

FIG. 5 is an additional timing diagram 500 illustrating the signals on selected lines illustrated in FIG. 3. The situation illustrated in FIG. 5 corresponds to the operation of an example of circuit 300 of FIG. 3 with an under-damped output voltage response to dynamic voltage changes. In FIG. 5, initially the voltage on the line target VREF of FIG. 3 is approximately the voltage labeled Vref1 at time t0. In this example, the voltage on the line target VREF of FIG. 3 transitions from this initial level to approximately the voltage labeled Vref2 in FIG. 5. Later, another transition occurs from voltage Vref2 to approximately the voltage Vref1. In response to this sequence of voltage levels on the line target VREF of FIG. 3, the VREF ramp generator (block 305 of FIG. 3) outputs a signal on the line VREF baseline of FIG. 3 that corresponds to the signal labeled "VREF baseline" (trace 505 of FIG. 5). In FIG. 5 the line VREF baseline starts ramping at time t1 from voltage Vref1 to a voltage Vref2 at time t2. In FIG. 5, the line VREF baseline is at voltage Vref2 at time t3 and then starts a ramp to transition to Vref1 at time t4. In response to the signals on the lines ramp timing and ramp direction of FIG. 3, the t arrangement offset voltage generator (block 301 of FIG. 3) outputs a signal on the line offset of FIG. 3 corresponding to the signal labeled "offset" (trace 501 of FIG. 5). When the signal on the line ramp timing of FIG. 3 transitions to a high level and the signal on the line ramp direction of FIG. 3 is high, the offset voltage generator (block 301 of FIG. 3) outputs the waveform corresponding to event 521 of trace 501 in FIG. 5 on the line offset of FIG. 3. When the signal on the line ramp timing of FIG. 3 transitions to a high level and the signal on the line ramp direction of FIG. 3 is low, the offset voltage generator (block 301 of FIG. 3) outputs the waveform corresponding to event 523 of trace 501 in FIG. 5 on the line offset of FIG. 3.

In the example of FIG. 5, the line offset transitions in a decreasing ramp starting at time t1 to a lower voltage level at time t1', remains level at that voltage until time t2, and then increases back to the 0 volts level at time t2', so that a multiple step offset voltage waveform is used. Later, at time t3 in event 523, the line offset (trace 501 in FIG. 5) ramps from the 0 volts level to a higher voltage at time t3', and the line offset remains at the higher voltage to time t4, where the line offset begins decreasing in a ramp from time t4 to time t4'. Again, a multi-step offset voltage waveform is used. In this example arrangement offset addition circuit (block 307 of FIG. 3) sums voltages on the lines VREF baseline and offset of FIG. 3 corresponding to the traces 505 and 501, respectively, of FIG. 5. The sum of these two voltages is output on the signal VREF of FIG. 3 corresponding the signal labeled VREF in FIG. 5 (trace 507 of FIG. 5). In response to the signal VREF (trace 507 of FIG. 5) the power supply adjusts the output voltage on the line VOUT of FIG. 3 corresponding to the signal labeled VOUT in FIG. 5 (trace 509 of FIG. 5) as described hereinabove.

Due to the voltage of the signal VREF (trace 507 of FIG. 5) being approximately the sum of the voltages of the signals VREF baseline (trace 505) and offset (trace 501) of FIG. 5, the voltage ramps of the signal VREF (trace 507) are delayed with respect to the voltage ramps of the signal VREF baseline (trace 505). Also, the voltage ramps of the signal VREF (trace 507) occur in two segments due to the summation of the voltages of the signals VREF baseline (trace 505) and offset (trace 501) of FIG. 5. The initial segments of the voltage ramps of the signal VREF are events 531 (increasing voltage ramp) and 533 (decreasing voltage ramp) of trace 507 in FIG. 5. The final segments of the voltage ramps of the signal VREF are events 535 (increasing ramp) and 537 (decreasing ramp) of trace 507 in FIG. 5. The voltage of the signal VREF (trace 507) changes more rapidly in the initial ramp segments (events 531 and 533) than in the final ramp segments (events 535 and 537). Because the voltage response of the signal VOUT (trace 509 of FIG. 5) is under-damped in response to voltage changes on the signal VREF (trace 507), the voltage of the signal VOUT tracks the voltage of the signal VREF with a small offset in time. The rapid voltage change of the initial ramps of the signal VREF (events 531 and 533) results in the voltage of the signal VOUT (trace 509) rapidly approaching the voltage of the signal VREF baseline (trace 505). The reduced rate of voltage change of the final ramp segments of the signal VREF (events 535 and 537) result in the voltage of the signal VOUT (trace 509) approximately reaching the voltages Vref2 (at time t2') and Vref1 (at time t4') with reduced or no overshoot and undershoot. Thus a power supply with an under-damped output voltage response employing the arrangements can be implemented such that requirements for the voltage of the signal VOUT (trace 509) completing a voltage ramp are met. Example delay, overshoot, and undershoot requirements are described hereinbelow.

The voltage of the signal VOUT (trace 509 of FIG. 5) is not to exceed the voltage VHmax in FIG. 5 when transitioning to approximately the voltage Vref2 in FIG. 5. The voltage of the signal VOUT (trace 509 of FIG. 5) is not to decrease below the voltage VLmin in FIG. 5 when transitioning to approximately the voltage Vref1 in FIG. 5. The example delay time requirements are now described. When the voltage of the signal VOUT (trace 509 of FIG. 5) is transitioning from approximately the voltage Vref1 in FIG. 5 to approximately the voltage of Vref2 in FIG. 5, the voltage of the signal VOUT (trace 509) is to increase to the voltage VHmin prior to time period TH following the completion of the voltage ramp of the signal VREF baseline (trace 505 of FIG. 5) to approximately the voltage Vref2. The voltage VHmin and the time period TH are illustrated in FIG. 5. In addition, when the voltage of the signal VOUT (trace 509) is transitioning from approximately the voltage Vref2 in FIG. 5 to approximately the voltage of Vref1 in FIG. 5, the voltage of the signal VOUT (trace 509) is to decrease to the voltage VLmax prior to time period TL following the completion of the voltage ramp of the signal VREF baseline (trace 505 of FIG. 1) to approximately the voltage Vref1. The voltage VLmax and the time period TL are illustrated in FIG. 5.

As described hereinabove, the voltage ramps of the signal VREF (trace 507 of FIG. 5) occur delayed following to the ramps of the signal VREF baseline (trace 505 in FIG. 5). The amount of time by which the initial voltage ramps (events 531 and 533 of trace 507 of FIG. 5) of the signal VREF (trace 507) are delayed from the corresponding ramps of the signal VREF baseline (trace 505) is a function of the maximum and minimum voltages of the waveforms on the signal offset (trace 501 of FIG. 5). The slopes of the final ramps (events 535 and 537 of trace 507 in FIG. 5) of the signal VREF (trace 507) are a function of the slopes trailing ramps of the waveforms (events 521 and 523 of trace 501 of FIG. 5) of the signal offset (trace 501).

In the operations shown in FIG. 5, the line offset takes multiple levels during the increasing ramp of the target VREF signal and also takes different multiple levels during the decreasing ramp of the target VREF signal. In a first operation in FIG. 5, shown as region 521 in the line offset (trace 501), at time t1 the line VREF baseline (trace 505) starts increasing from the initial voltage Vref1. At time t1, the line offset (trace 501) begins a decreasing ramp until time t1'. Due to the operation of the offset addition circuit (307 in FIG. 3), voltage VREF (trace 507) does not begin to increase until after time t1', when the line offset becomes a level voltage at a voltage less than 0 volts. At time t1' the line VREF (trace 507) beings increasing at a slope that matches the slope of the line VREF baseline (trace 505) due to the operation of the addition block (307 in FIG. 3). At time t2, the line VREF baseline (trace 505) reaches the voltage Vref2. At time t2, the line VREF (trace 507 in FIG. 5) changes slope as the line offset begins to increase in voltage but now at a different slope than at time t1; since the line VREF baseline is now level starting at time t2, the VREF line (trace 507) increases at the reduced ramp due to the operation of the addition block (block 307 in FIG. 3). Region 531 shows this portion of the operation in FIG. 5. At time t2' the offset line (trace 501) returns to the 0 volts level and remains level, and at time t2' in FIG. 5 the line VREF (trace 507) reaches voltage Vref2. Due to the operation of the arrangement of FIG. 3 with the multiple step offset voltage, the output voltage VOUT (trace 509 in FIG. 5) reaches Vref2 at about time t2'. As shown in FIG. 5, the voltage VOUT does not exhibit any overshoot as it rises to Vref2.

In a second operation shown in FIG. 5, at time t3, the line VREF baseline (trace 505) begins transitioning from Vref2 at time t3 to a voltage level Vref1 at time t4. At time t2, the line offset (trace 501) increases in a first ramp to time t3'. At time t3', the line offset (trace 501) reaches a level high voltage and remains at this level. The line VREF (trace 507) remains at level Vref2 until time t3' due to the operation of the offset addition block in FIG. 3. When the offset voltage (trace 501) becomes level at time t3', the VREF voltage (trace 507) begins falling at the same slope as VREF baseline (trace 505), this is shown as event 533 in FIG. 5. At time t4, the voltage VREF baseline reaches the voltage level Vref1 and becomes a level voltage. At time t4, the offset voltage (trace 501) begins falling at a reduced ramp slope that is a different slope than the increasing ramp slope at time t3, until the line offset (trace 501) reaches 0 volts at time t4'. The line VREF (trace 509) falls at the same reduced ramp slope between time t4 and time t4', this is shown as event 537 in FIG. 5. Due to the operation of the arrangements, the output voltage VOUT falls at this same ramp slope from time t4 to time t4', to voltage Vref1, with no undershoot. Thus by use of the arrangements, the output voltage Vout transitions from a first voltage Vref1 to a higher voltage Vref2 without any overshoot and then transitions from voltage Vref2 to the lower voltage Vref1 without any undershoot. As shown in FIG. 5, the timing requirements TH and TL are met in that the output voltage VOUT (trace 509) reaches the voltage VHmin just after time t2, and similarly falls to a voltage lower than VLmax just after time t3, thus closely tracking the VREF baseline voltage (trace 505).

For offset voltage waveforms on the line offset of FIG. 3 that are pulses as illustrated in the example of FIG. 4 (trace 401), various approaches can be used to implement the example offset voltage generator (block 301 of FIG. 3). One such approach is to use transistors as switches to couple the line offset of FIG. 3 to a positive fixed voltage supply, ground, and a negative fixed voltage supply in the sequences necessary to generate the waveforms illustrated as events 421 and 423 of trace 401 in FIG. 4.

For offset voltage waveforms on the line offset of FIG. 3 that include voltage ramps as illustrated in the example of FIG. 5 (trace 501), various approaches can be used to implement the example offset voltage generator (block 301 of FIG. 3). One such approach is to use transistors as switches to couple the line offset (of FIG. 3) to ramping voltage supplies, fixed voltage supplies, and ground in the sequences necessary to generate the waveforms illustrated as events 521 and 523 of trace 501 in FIG. 5. These voltage ramps can be implemented with various approaches including current sources that charge and discharge capacitors. Digital circuitry including digital-to-analog converters (DACs) can be used to generate desired voltage ramps for the line offset. Various approaches can be used to implement the offset addition circuit (block 307 of FIG. 3) to sum the voltages on the lines offset and VREF baseline of FIG. 3. An amplifier such as an operational amplifier can be arranged as a voltage summer with variable gain in a feedback loop, for example. Other summing circuitry such as simple resistor voltage summers can be used.

The voltage on the line VOUT of FIG. 3 can transition between multiple voltage levels. Specifically, variable power supplies can be implemented with the arrangements that can transition to more than the two voltage levels (the voltages Vref1 and Vref2 of FIGS. 4 and 5) described hereinabove. For such power supplies, the function of circuit 300 of FIG. 3 for transitions between any two output voltage levels is similar to the transitions described hereinabove between the example voltages Vref1 and Vref2 in FIGS. 4 and 5.

Figure 6:
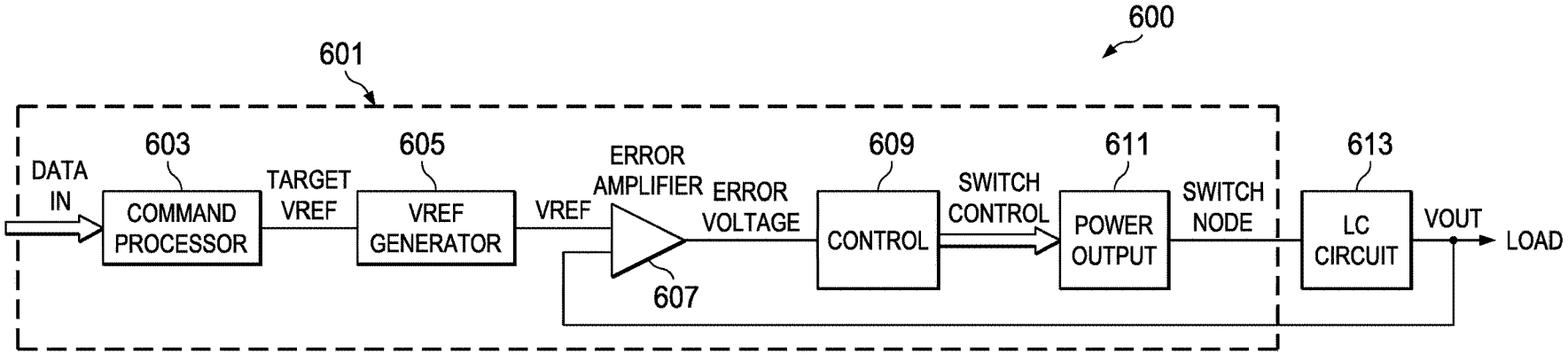
FIG. 6 is a block diagram of a power supply that includes an example arrangement.

FIG. 6 is a block diagram of an example power supply circuit 600. Circuit 600 is a power supply that includes an example arrangement including an overshoot, undershoot, and delay reduction circuit. The overshoot, undershoot and delay reduction circuitry is a portion of the VREF generator (block 605 of FIG. 6). In an example arrangement, the circuit 601 can be formed as a single integrated circuit (IC). In an additional example, the circuit 601 can be formed using multiple integrated circuits and/or discrete components mounted on a board or a module. Multiple integrated circuits can be packaged in a single unit, such as stacked die packages or multichip modules, for ease of use and to further increase integration. User defined semi-custom integrated circuits including field programmable gate arrays (FPGAs), complex programmable logic devices (CPLDs), and application specific integrated circuits (ASICs) can implement the circuit 601 of FIG. 6. Custom integrated circuits can also be used. Circuit 600 of FIG. 6 includes the inductive capacitance (LC) circuit (block 613 of FIG. 6) external to circuit 601 of FIG. 6. The LC circuit (block 613) includes passive circuit elements such as inductors and capacitors. Such passive components of a power supply are often external to integrated circuits and mounted on a circuit board or in a module. In an alternative arrangement, some or all of the passive components in the LC circuit 613 are formed on the integrated circuit 601. In a further arrangement, the passive components in LC circuit 613 can be included in a single packaged component including the integrated circuit 601.

In FIG. 6, the bus labeled "data in" is coupled to an external circuit such as a microprocessor. The bus data in of FIG. 6 includes data and control lines. The command processor (block 603 of FIG. 6) is coupled to the bus data in of FIG. 6. An output of the command processor (block 603) is coupled to the line labeled "target VREF" in FIG. 6. The line target VREF is coupled to an input of the VREF generator (block 605 of FIG. 6). The voltage reference output of the VREF generator (block 605) is coupled to the line labeled VREF in FIG. 6. The line VREF of FIG. 6 is coupled to an input of the error amplifier (607 of FIG. 6). The output of the error amplifier (607) is coupled to the line labeled "error voltage" of FIG. 6. The line error voltage of FIG. 6 is coupled to an input of the control circuit (block 609 of FIG. 6). The outputs of the control circuit (block 609) are coupled to the group of lines labeled "switch control" in FIG. 6. Examples of lines included in the group of lines labeled switch control in FIG. 6 are high-side and low-side gate control lines for power transistors. The group of lines labeled switch control of FIG. 6 is coupled to inputs the power output circuit (block 611 of FIG. 6). An output of the power output circuit (block 611) is coupled to the line labeled "switch node" in FIG. 6. The line switch node of FIG. 6 is coupled to the LC circuit (block 613 of FIG. 6). The output of the LC circuit (block 613) is coupled to the line labeled VOUT of FIG. 6. The line VOUT in FIG. 6 is the voltage output of the power supply 600 of FIG. 6. The line VOUT of FIG. 6 is coupled to circuits being powered by the power supply (600). The label "load" of FIG. 6 indicates these circuits.

The line VOUT of FIG. 6 is also coupled to an input of the error amplifier (607 of FIG. 6) to provide a feedback for the control loop formed by the error amplifier 607, the control circuit 609, and the power output circuit 611. The IC 601 of FIG. 6 can contain additional circuits not illustrated in FIG. 6 and not described herein for simplicity of explanation. Examples of such circuits include "soft start" control, "power good" indicator, over and under voltage protection, excessive current protection, high temperature protection, and linear voltage regulators. Such additional circuits can be included in circuit 601 with corresponding modifications for operation as intended. The example of FIG. 6 is a switched power supply. In this example, the control circuit (block 609 of FIG. 6) includes circuitry for pulse width modulation (PWM) signal generation and circuitry to adjust the PWM duty cycle in response to the signal on the line error voltage of FIG. 6. Block 609 also includes circuitry to generate signals such as high-side and low-side gate control within the group of signals labeled switch control of FIG. 6. The power output circuit (block 611 of FIG. 6) includes the high-side and low-side power transistors and the gate drivers for these transistors. Block 611 also includes a circuit to prevent "cross conduction" through the power transistors. Block 611 can contain additional circuits not described herein for simplicity of explanation.

In FIG. 6 the VREF generator (block 605 of FIG. 6) corresponds to block 305 of FIG. 3 and the circuitry 321 of FIG. 3 interconnected as illustrated in FIG. 3. The error amplifier (607 of FIG. 6) corresponds to the error amplifier (313 of FIG. 3). The blocks control (609 of FIG. 6) and power output (611 of FIG. 6) coupled with the group lines labeled switch control in FIG. 6 correspond to the control and power output circuit (block 309 of FIG. 3). The signals on the lines target VREF, VREF, error voltage, and VOUT in FIG. 6 correspond respectively to the signals on the lines with these same labels in FIG. 3.

In operation of the circuit 600 of FIG. 6, the behavior of the signals on the lines target VREF, VREF, error voltage, and VOUT in FIG. 6 are similar to the behavior of the signals on respective lines with these same labels in FIG. 3. The block 605 of FIG. 6 functions similarly to the combined blocks 301, 305, and 307 of FIG. 3. Circuit 607 of FIG. 6 functions similarly to circuit 313 of FIG. 3. The combined functionality of blocks 611, 609, and 613, of FIG. 6 is similar to the functionality of block 309 of FIG. 3. This similar behavior of signals and similar functionality of circuits and blocks of FIGS. 3 and 6 occur when a voltage transition on the line target VREF of FIG. 6 is similar to a voltage transition on the line target VREF of FIG. 3. In the example of FIG. 6, the voltage level on the signal target VREF of FIG. 6 is output by the command processor (block 603 of FIG. 6) in response to a command received on the bus data in in FIG. 6. A voltage transition on the line target VREF of FIG. 6 occurs when a command is received for a specific power supply output voltage that is different than the present power supply output voltage. The command processor (block 603) includes a digital to analog converter (DAC) (or other circuit) to generate the voltage output on the line target VREF of FIG. 6.

Alternative arrangements can be implemented with circuits or components that differ from those described hereinabove. For example, the alternative arrangements can be implemented with the following: different approaches for converting the VREF baseline waveforms (traces 405 and 505 of FIGS. 4 and 5) to waveforms similar to traces 407 and 507 of FIGS. 4 and 5 respectively; different offset voltage waveform shapes (traces 401 and 501 of FIGS. 4 and 5); and different approaches for generating the offset voltage waveforms (traces 401 and 501 of FIGS. 4 and 5). In other alternative arrangements it may be advantageous to combine some or all of the functionality of blocks 301, 305, and 307 of FIG. 3 into a single circuit. The hereinabove described alternative arrangements can be implemented with corresponding circuit modifications to the example of FIG. 3 for operation as intended.

As illustrated in FIGS. 4 and 5, the voltage on the line offset of FIG. 3 (corresponding to the traces 401 and 501 in FIGS. 4 and 5) transitions to both positive and negative voltages. As illustrated in traces 401 and 501 of FIGS. 4 and 5 the voltage on the line offset of FIG. 3 is approximately zero when inactive. For implementations where operating voltages are always positive, alternative arrangements can be implemented such that the voltage on the signal offset of FIG. 3 is always positive with an approximately fixed positive voltage level when inactive. For such an implementation this approximately fixed positive voltage can be subtracted by the offset addition circuit (block 307 of FIG. 3) when generating the signal on the line VREF of FIG. 3. A similar approach, not described herein for simplicity of explanation, can be used to implement examples where operating voltages are always negative.

Variable power supplies implemented with the arrangements can result in power supplies with the characteristics of reduced output voltage overshoot, reduced undershoot, and reduced settling delay. Using the arrangements, power supplies with these characteristics can be implemented without employment of alternative approaches such as increasing control loop bandwidth that can result in reduced power supply efficiency.

Figure 7:
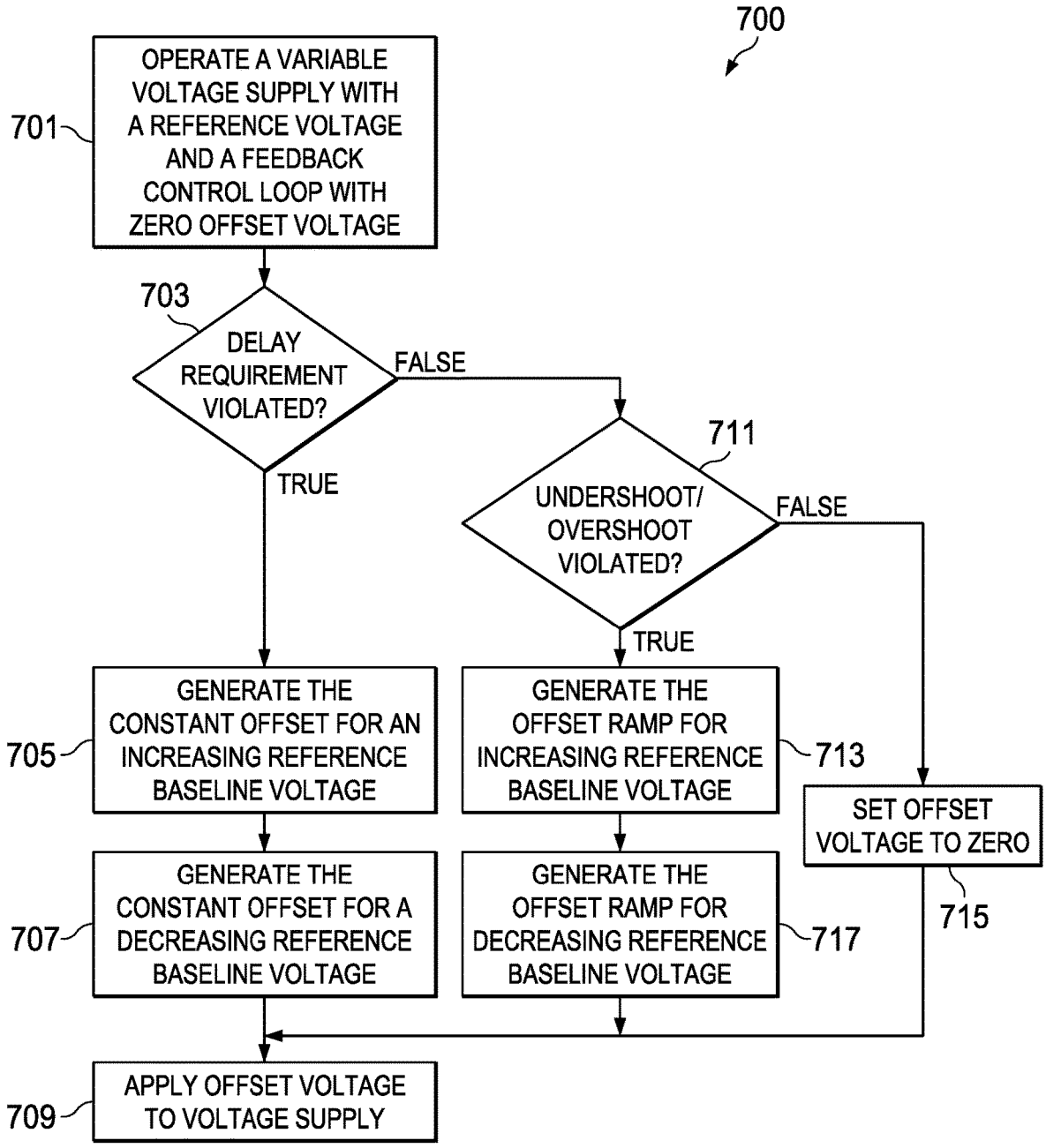
FIG. 7 illustrates in a flow diagram an example method.

In order to employ the arrangements in general to power supply with a control loop, a determination is made as to what kind of offset is needed. In FIG. 7, a method arrangement 700 is shown in a flow diagram.

In FIG. 7, the method begins at step 701 by operating a power supply to provide a variable voltage output set by a reference voltage using a control feedback loop. In step 703, a first decision is made to determine whether the power supply output transition violates a transition maximum delay time requirement. This situation was described hereinabove and illustrated in FIG. 1. If the decision in step 703 is true, then the method transitions to step 705. If the decision in step 703 is false, then the method transitions to step 711.

At step 711, a decision is made to determine whether the maximum undershoot and maximum overshoot requirements are violated. This situation is illustrated, for example, in FIG. 2, described hereinabove, for an under-damped control loop.

Returning to step 705 in FIG. 7, in this step the method determines a level offset voltage for the situation when the reference voltage is increased. This situation is shown, for example, in FIG. 4 at event 421. The level of offset voltage needed depends on the particular characteristics of the error amplifier and power supply circuitry such as in FIG. 3, and can be determined by experiment, or by circuit simulation, so that the VREF signal is corrected sufficiently to cause the output of the variable voltage supply to closely track the VREF baseline during the increasing voltage ramp. Using the arrangements will cause the output voltage transition to meet the delay time requirements as described hereinabove.

The method then continues at step 707 and determines the offset voltage needed during the decreasing reference baseline voltage. This situation is illustrated as event 423 in FIG. 4. The offset voltage in some arrangements is negative during the transition from a higher reference voltage to a lower reference voltage. In alternative arrangements, the offset voltage at event 423 in FIG. 4 can be positive but the adder circuitry in FIG. 3 can subtract the offset voltage (instead of adding it) to the baseline reference voltage. Again, the amount of offset voltage needed to correct the output voltage VOUT to meet the delay time requirements can be determined using circuit simulation tools or by experiment on an example device.

After the offset voltage levels for both the increasing reference baseline voltage in step 705 and the decreasing reference baseline voltage in step 707 are determined, the method transitions to step 709 where the offset voltages are applied to the arrangements.

Returning to step 703, if the determination is false, then the delay time requirements for the variable voltage supply are not being violated, and the method transitions to step 711 to determine whether the maximum requirements on undershoot and overshoot are being violated.

If the determination in step 711 is false, the method transitions to step 715 in FIG. 7. The determination that the maximum undershoot and maximum overshoot requirements are not violated indicates that the variable voltage supply is meeting the delay time requirements, tested in step 703, and in step 711, is meeting the maximum undershoot and maximum overshoot requirements. In this situation, at step 715, the offset voltage is set to zero volts (no offset needed). The method then transitions to step 709, where the offset voltage is applied.

Returning to step 711, if the determination is true, then the variable voltage supply is violating the maximum undershoot and/or maximum overshoot requirements. This situation is illustrated in FIG. 2 hereinabove. In this situation an offset adjustment is needed to correct the output voltage of the variable voltage supply.

At step 713, the offset ramp for the situation for an increasing reference baseline voltage is determined. In FIG. 5, described hereinabove, this situation is illustrated as event 521. In the arrangements described above, a multiple step offset voltage waveform is used having three steps. In alternative arrangements, the offset voltage waveform can have more steps.

The particular offset voltage waveform needed to correct for overshoot during the increasing baseline reference voltage situation can be determined by use of circuit simulators or through experiments using an example variable voltage supply. The amount of voltage needed in the offset voltage waveform depends on the particular characteristics of the error amplifier and the power circuitry used in the variable voltage supply.

After the offset voltage waveform for an increasing reference baseline voltage is determined in step 713, the method of FIG. 7 continues at step 717. In step 717, the offset waveform is determined for the example of a decreasing baseline reference voltage. This situation is shown in FIG. 5 at event 523, for example. In this situation, the offset voltage ramps positive from an initial zero voltage to a positive level, stays at the positive level voltage for a period of time, and then decreases in a negative ramp back to the zero voltage level. Again, the offset voltage waveform needed to correct a particular variable voltage supply can be determined using a circuit simulator or by experiment.

After the offset voltage waveform for the decreasing reference baseline voltage situation is determined, the method in FIG. 7 transitions to step 709, where the offset voltage waveform is applied to the voltage supply.

Figure 8:
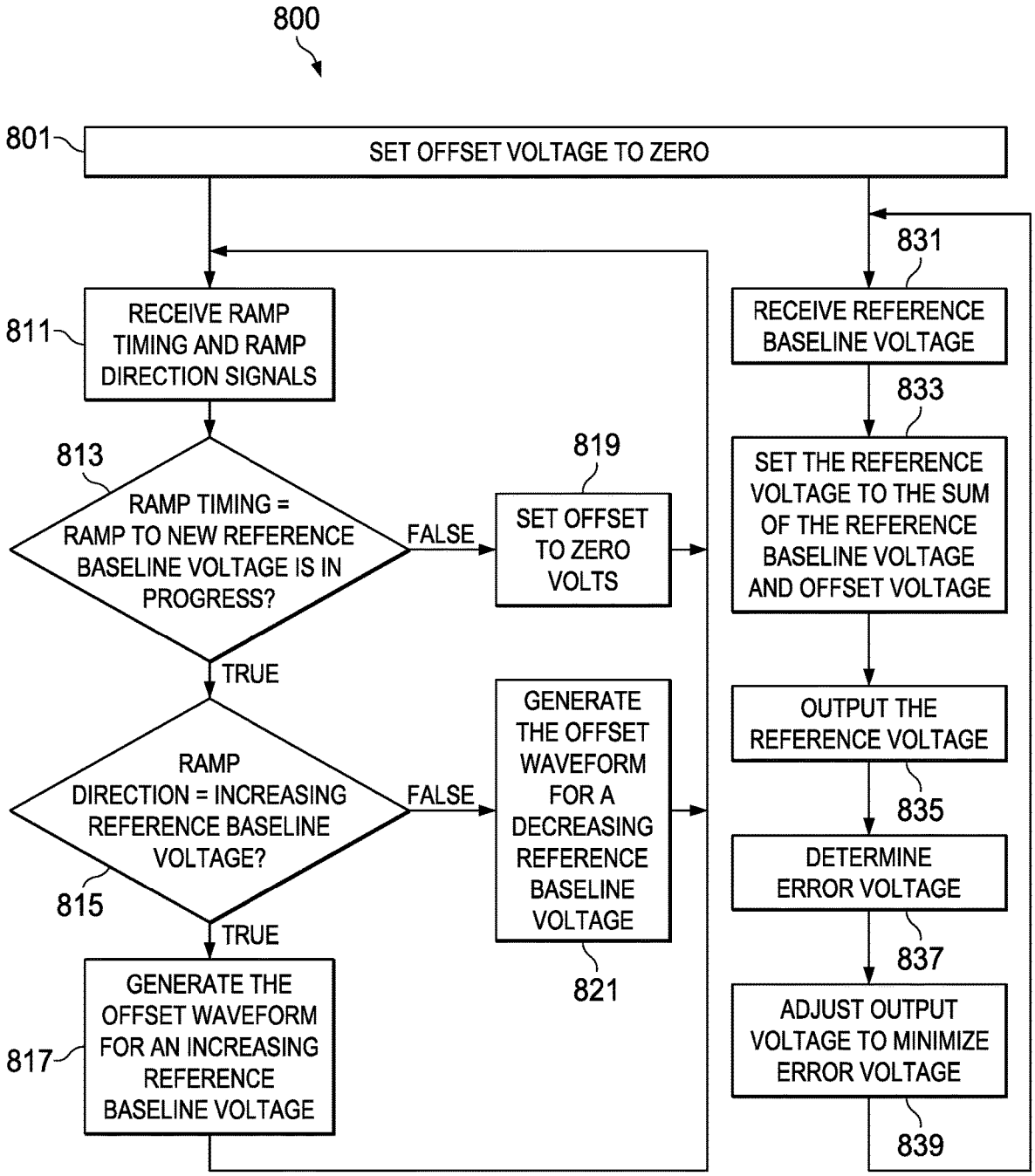
FIG. 8 illustrates in another flow diagram an additional example method.

FIG. 8 illustrates in a flow diagram an example method 800. Method 800 begins at step 801 in which the offset voltage is initially set to zero. From step 801 the method transitions to steps 811 and 831 in parallel.

At step 811 the signals "ramp timing" and "ramp direction" are received. From step 811 the method transitions to step 813.

At step 813 a determination is made. If the ramp timing signal indicates that the reference baseline voltage is transitioning to a different voltage level, the determination is true and the method transitions to step 815. At step 815 another determination is made. If the signal ramp direction indicates that the reference baseline voltage is increasing, the determination is true and the method transitions to step 817. Returning to step 813, if the determination is false, the method transitions to step 819. At step 819 the offset voltage is set to zero. From step 819 the method returns to step 811.

At step 817, an offset voltage waveform is generated. This waveform is predefined for cases where the reference baseline voltage is increasing. The method of FIG. 7 described hereinabove can be used to determine the offset voltage waveform. From step 817 the method transitions to step 811. Returning to step 815, if the determination is false, the method transitions to step 821. At step 821, an offset voltage waveform is generated. This waveform is predefined for cases where the reference baseline voltage is decreasing. The method of FIG. 7 described hereinabove can be used to determine the offset voltage waveform, for example. From step 821 the method transitions to step 811.

At step 831 the reference baseline voltage is received. From step 831 the method transitions to step 833. At step 833 the instantaneous reference baseline voltage and the instantaneous offset voltage (see steps 801, 817, 819, and 821) are summed. The reference voltage is set equal to this sum. From step 833 the method transitions to step 835. At step 835 the reference voltage is output by the method. At step 837, the method uses the reference voltage to determine the error voltage, the difference between the current voltage output by the variable voltage supply and the reference voltage. At step 839, the output voltage is adjusted to minimize the error voltage, so that the output voltage from the variable voltage supply is adjusted to the reference voltage as described hereinabove. From step 839 the method transitions to step 831 and continues. It should be noted that in FIG. 8, steps 831, 833, 835, 837 and 839 operate in parallel with the operation of the steps with labels numbered in the range 811 through 821.

The offset voltage waveforms generated in steps 817 and 821 of method 800 are predefined for characteristics of a specific power supply implementation. These offset voltage waveforms differ depending on whether a specific power supply is implemented with over damped or under damped output voltage response to dynamic voltage transitions. Various power supply characteristics, not described herein for simplicity of explanation, may also influence the characteristics of these waveforms. Note that the order of steps illustrated in the example arrangement of FIG. 8 illustrate one approach to performing the method 800. Alternative method arrangements can use a different order of steps. For example, step 811 can transition to step 815 with duplicates of step 813 occurring prior to steps 817 and 821.

Modifications are possible in the described arrangements, and other additional arrangements are possible that form further arrangements that fall within the scope of the claims.

What is claimed is:

1. A method, comprising:

receiving a target input reference voltage at an input of a ramp generator;

detecting a voltage ramp in the target input reference voltage by producing from the ramp generator voltage ramp timing and direction signals;

generating an offset voltage in response to detecting the voltage ramp in the target input reference voltage;

adding the offset voltage to the voltage ramp of the target input reference voltage to generate a first reference voltage; and supplying an output voltage that varies in response to the first reference voltage.

2. The method of claim 1, in which generating an offset voltage waveform further includes:

performing a first determining to determine whether output voltage transitions in response to a change in the input reference voltage violate a delay time requirement;

performing a second determining to determine whether the output voltage transitions in response to a change in the input reference voltage violates either a maximum undershoot requirement or a maximum overshoot requirement;

responsive to the first determining, generating a first offset voltage waveform to correct the output voltage to meet the delay time requirement; and responsive to the second determining, generating a second offset voltage waveform to correct the output voltage to meet the maximum undershoot and maximum overshoot requirements.

3. The method of claim 2, in which in response to both the first determining and the second determining being negative, generating the offset voltage waveform sets the offset voltage to zero.

4. The method of claim 2, in which responsive to the first determining being positive, generating a first offset voltage waveform to correct the output voltage further includes generating a level offset voltage waveform.

5. The method of claim 4, in which in response to a voltage ramp transition at the input reference voltage, outputting the offset voltage waveform includes outputting the level offset voltage waveform as a positive offset voltage in response to a negative voltage ramp transition and as a negative offset voltage in response to a positive voltage ramp transition.

6. The method of claim 2, in which responsive to the second determining being positive, generating a second offset voltage waveform to correct the output voltage further including generating a multiple step offset voltage waveform.

7. The method of claim 6, in which generating a multiple step offset voltage waveform further includes generating a first voltage ramp from a zero voltage to a voltage level, generating a level offset voltage at the voltage level, and then generating a second voltage ramp from the voltage level to a zero voltage level;

in which the multiple step offset voltage waveform is negative in response to a positive voltage ramp in the input reference voltage, and the multiple step offset voltage waveform is positive in response to a negative voltage ramp in the input reference voltage.

8. The method of claim 1 in which the generating an offset voltage waveform includes generating the offset voltage waveform in response to the ramp timing signal and the ramp direction signal.

9. An apparatus, comprising:

a reference voltage ramp generator having a target reference voltage input and control outputs;

an offset voltage waveform generator having inputs coupled to the control outputs and an offset voltage output;

an offset addition circuit having one input coupled to the offset voltage output, another input coupled to the target reference voltage input, and a first reference voltage output; and a power supply circuit having an input coupled to the first reference voltage and a variable voltage output.

10. The apparatus of claim 9, in which the power supply circuit includes an error amplifier circuit coupled to a power supply output circuit in a feedback loop, the error amplifier circuit having one input coupled to the variable voltage output, another input coupled to the first reference voltage output, and an output coupled to the power supply output circuit.

11. The apparatus of claim 10, in which the offset voltage waveform generator outputs a level offset voltage.

12. The apparatus of claim 11, in which the level offset voltage is a negative offset voltage.

13. The apparatus of claim 11, in which the level offset voltage is a positive offset voltage.

14. The apparatus of claim 9, in which the reference voltage ramp generator detects a transition in the input reference voltage and outputs control signals to the offset voltage waveform generator.

15. The apparatus of claim 14, in which the reference voltage ramp generator detects a negative voltage ramp transition in the input reference voltage and outputs the control signals to cause the offset voltage waveform generator to output a positive level offset voltage.

16. The apparatus of claim 14, in which the reference voltage ramp generator detects a positive voltage ramp transition in the input reference voltage and outputs the control signals to cause the offset voltage waveform generator to output a negative level offset voltage.

17. The apparatus of claim 14, in which the offset voltage waveform generator outputs a multiple step offset voltage waveform.

18. The apparatus of claim 17, in which the offset voltage waveform generator outputs a negative multiple step offset voltage waveform.

19. The apparatus of claim 17, in which the offset voltage waveform generator outputs a positive multiple step offset voltage waveform.

20. The apparatus of claim 9 in which the control outputs of the reference voltage ramp generator include a ramp timing output and a ramp direction output.

* * * * *